United States Patent [19]

Pilboue

[11] 4,389,025

[45] Jun. 21, 1983

[54] APPARATUS FOR WINDING WIRE NET WITH SIMPLE TWIST

[75] Inventor: Pierre Pilboue, Charleville, France

[73] Assignee: Trefileries et Cableries Chiers-Chatillon-Gorcy, Levallois-Perret, France

[21] Appl. No.: 216,656

[22] Filed: Dec. 15, 1980

[30] Foreign Application Priority Data

Dec. 19, 1979 [FR] France ..... 79 31109

[51] Int. Cl.[3] ..... B65H 17/06; B65H 17/20

[52] U.S. Cl. ..... 242/55; 242/67.2; 242/DIG. 3

[58] Field of Search ..... 242/55, DIG. 3, 55.1, 242/67.2, 67.1 R, 75.1, 54 R; 100/87, 88; 53/118, 430

[56] References Cited

U.S. PATENT DOCUMENTS

| | | | |
|---|---|---|---|
| 1,662,577 | 3/1928 | Johnson | 242/DIG. 3 |
| 1,959,418 | 5/1934 | Fourness | 242/67.1 R X |
| 3,532,281 | 10/1970 | Verstraete | 242/55 |
| 3,776,482 | 12/1973 | Mras | 242/DIG. 3 |
| 4,063,693 | 12/1977 | Achelpohl et al. | 242/67.1 R |
| 4,139,976 | 2/1979 | Herrig et al. | 242/54 R X |
| 4,146,188 | 3/1979 | Hewinson et al. | 242/67.1 R |

FOREIGN PATENT DOCUMENTS 1594975 7/1970 France .

*Primary Examiner*—John M. Jillions
*Attorney, Agent, or Firm*—Brisebois & Kruger

[57] ABSTRACT

Simple twist wire net in which adjacent rows can pivot relative to each other is folded, accordian fashion, and rolled to form a compact roll. Driven strands in the form of belts or chains, spaced apart a distance equal to the distance between valleys of the folded net, engage in the valleys to maintain the accordian folded rows aligned and to form the compact roll.

5 Claims, 9 Drawing Figures

APPARATUS FOR WINDING WIRE NET WITH SIMPLE TWIST

Figure 1:
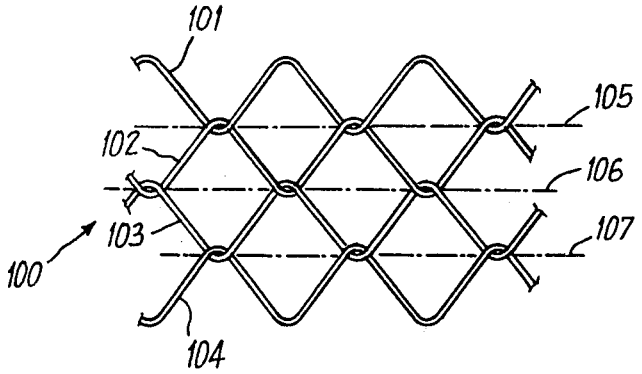

The present invention relates to an apparatus for rolling up simple twist wire net in which rows of the mesh are turned on themselves around their median lines of articulation, alternately in one direction and then in the other, in such a manner as to obtain a kind of accordion folding.

Such rolls of netting are described in French Pat. No. 1,594,975. This patent describes an apparatus for such rolling up of simple twist wire net which is generally satisfactory.

A disadvantage in this apparatus resides nevertheless in the fact that the machine for manufacture of the netting must be stopped each time a finished roll is to be removed from the apparatus. It thus results in a loss of time detrimental to the output of the installation.

The present invention aims to provide such a device which can be used downstream of a machine for manufacture of simple twist netting and which does not require the machine to be stopped each time a roll of net is removed from the device.

Another object of the invention is to provide apparatus permitting the production of more regular rolls than the known devices.

For this result, the present invention has for an object, apparatus for forming a roll of simple twisted net in which the rows of mesh are turned on themselves around their median lines of articulation, and in which the net can be fed at a predetermined speed, in the form of an elongated sheet by the discharge roller of a manufacturing installation for such net, characterized by the fact that it comprises, for supporting the roll of net, at least two assemblies in the shape of a V of two strands or rims of a device such as a chain, the planes of each of the assemblies being essentially perpendicular to the axis of the roll, these assemblies being spaced apart from each other by a distance approximately equal to a multiple of the diagonal spacing of the mesh of the particular net, and each strand being able to engage in the chevron form of the rows of folded mesh, and in which the strands are adjusted to be driven at a longitudinal speed less than the speed at which the net approaches the apparatus.

Preferably, the ratio between the speed of the strands and the predetermined speed is of the order of 0.25.

Also preferably the branch of the V on which the netting is fed makes an angle of about 40° with the horizontal.

Moreover the two branches of the V form preferably between themselves an angle of the order of 40°.

In one preferred embodiment of the invention, each of the assemblies in the form of a V is composed of a device such as an endless chain extending around a plurality of wheels, one of which is positioned at each of the ends of the branches of the V.

It is of course possible to use in these assemblies in the shape of a V, a belt rolling on pulleys, or also ropes, cables, or wires rolled in the form of springs, etc.

Advantageously, a third wheel is provided between the two first wheels to cause the chain to take approximately the form of a V, the apex of the V being formed by fourth and fifth pinch wheels placed respectively between the third wheel and each of the two first wheels.

The third wheel may be movable in the plane of the V in a direction essentially between the two branches of the V in order to compensate for the progressive increase of the diameter of the roll of net as it is formed.

A sixth chain return wheel can also be provided in the plane of the V, on the side opposite to that of the two first wheels with respect to the third wheel.

The longitudinal speed of the strands of chain is preferably supplied by means of one of the two first wheels which for this purpose is driven.

In one advantageous embodiment of the invention, at least one of the two first wheels is mobile in the plane of the V and is able to attain a position where it is approximately at the level of the vertex of the V, so that the corresponding branch of the V is approximately horizontal.

In this case, the mobile wheel can be swingable around the center of a fifth wheel which is adjacent the interior of the V.

In addition, the two first wheels can then be fixed, an ejector roller being provided in the plane of the V to displace it with the movable wheel to deform the strand corresponding to the fixed wheel in the direction of the movable wheel.

The ejector roller can by preference be a chain wheel in order to permit the device to continue to turn while a finished roll of net is removed from the device.

In a preferred embodiment of the invention, support angles are provided in the plane of each of these V shaped assemblies between the discharge roller of the net making machine and the end of one of the branches of the V, these angles presenting an edge facing upwardly.

This arrangement permits starting from the discharge of the machine for manufacture of the netting the folding of each row of mesh on itself around its median line of articulation.

In this case the edge is advantageously approximately in the extension of the strand corresponding to the branch of the V.

Other characteristics and advantages of the invention will become apparent in the description which follows of one embodiment given by way of non-limiting example.

Figure 2:
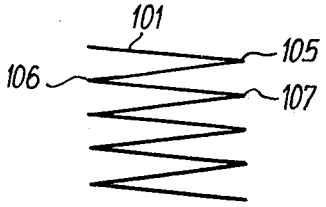
Figure 3:
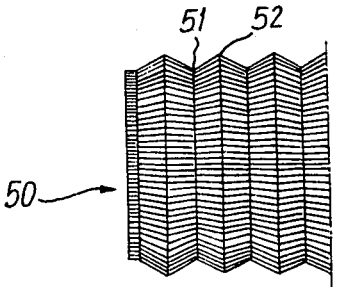
Figure 4:
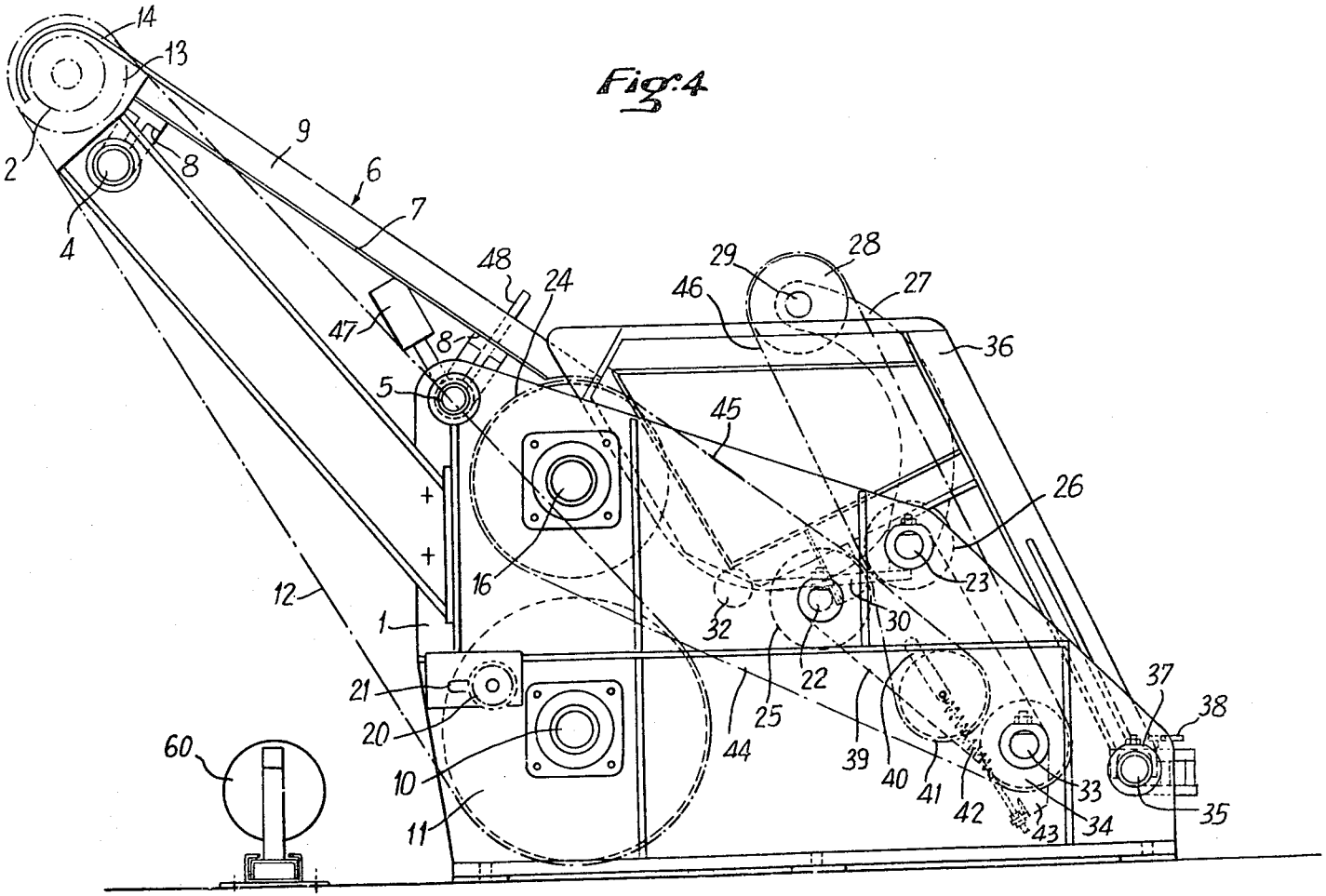
Figure 5:
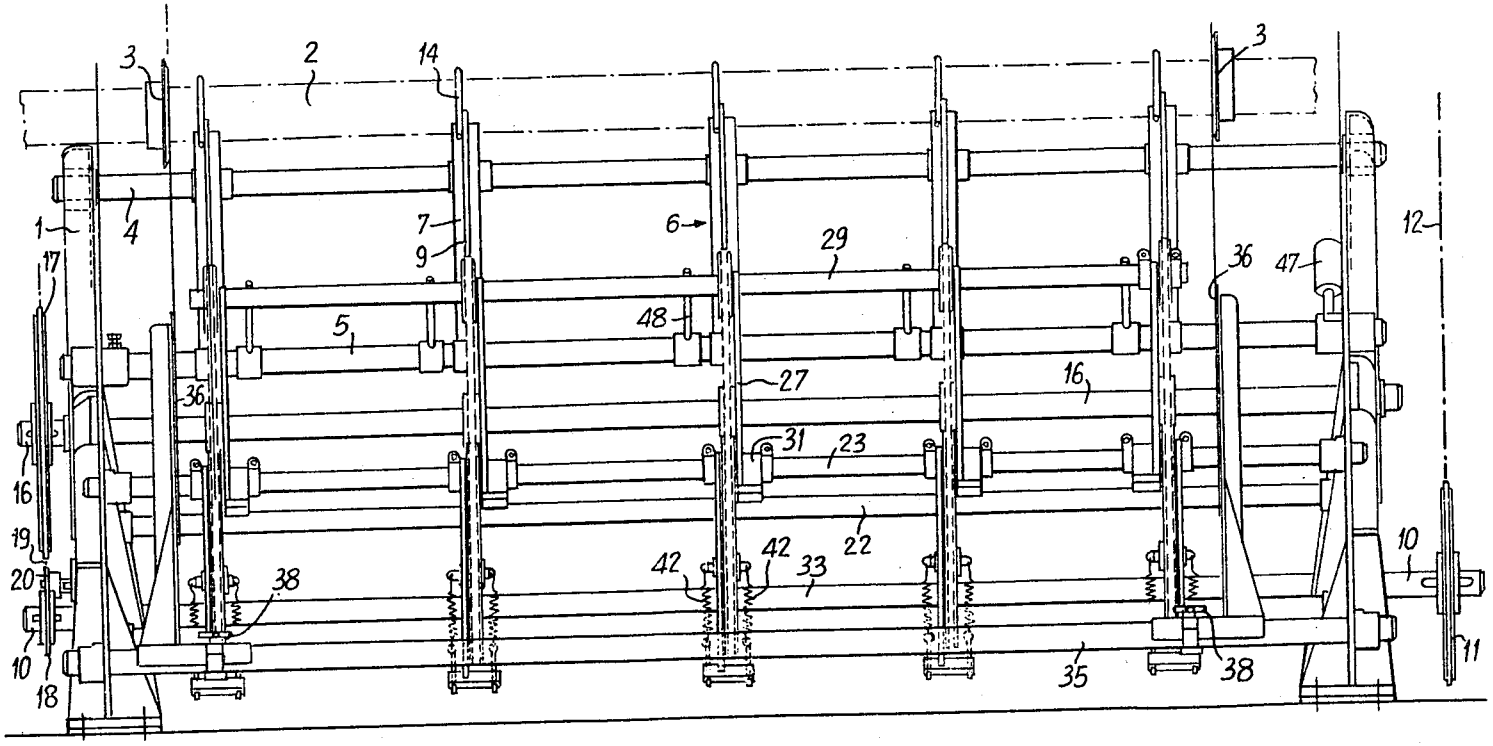
Figure 6:
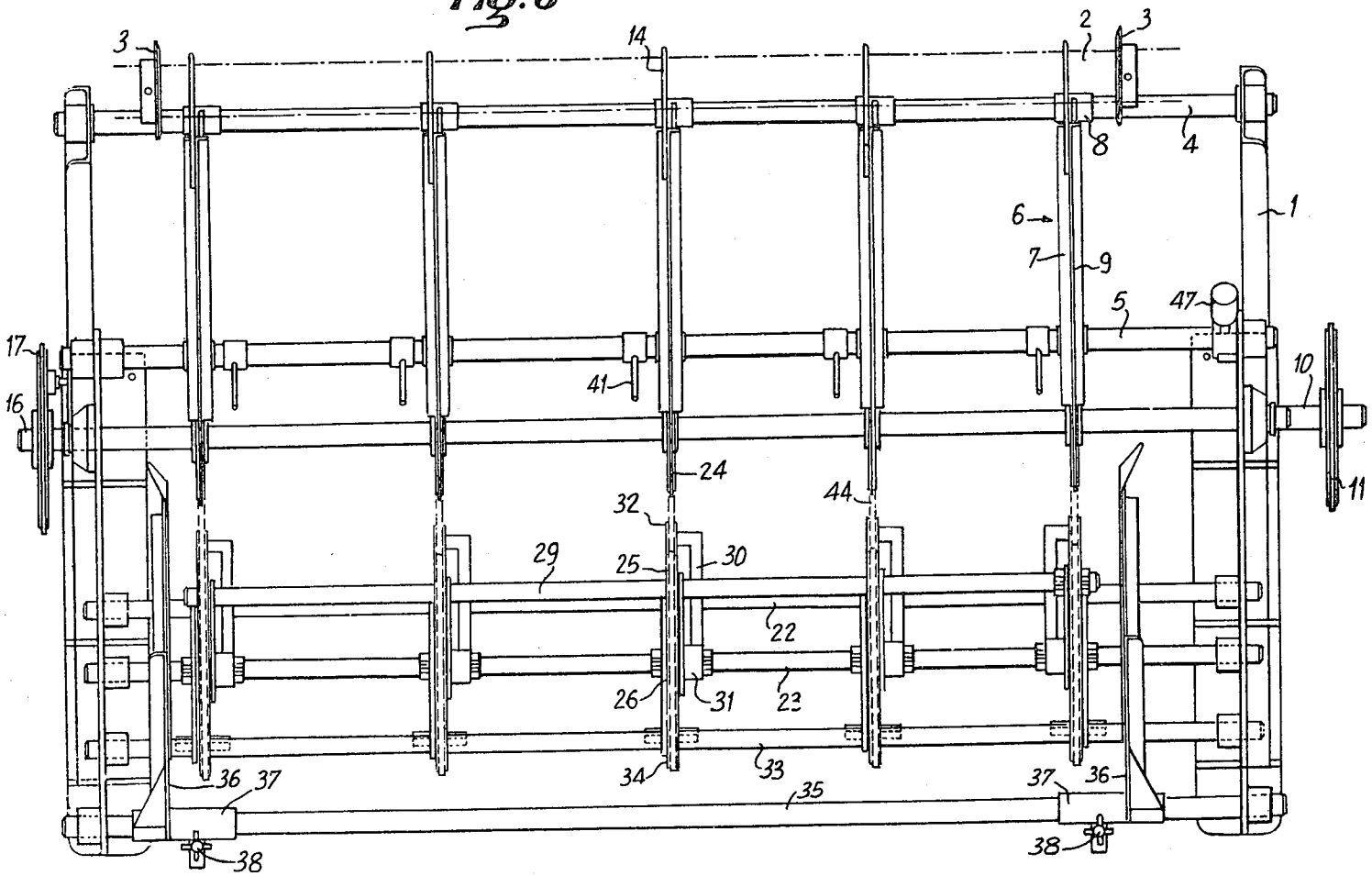
Figure 7:
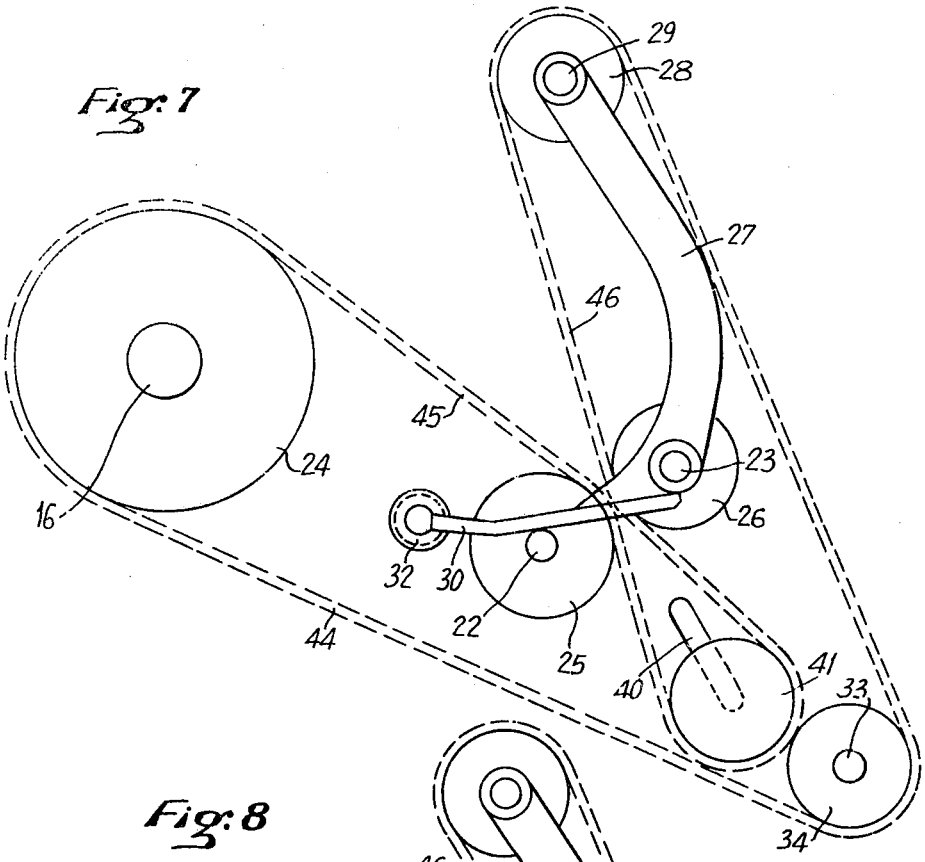
Figure 8:
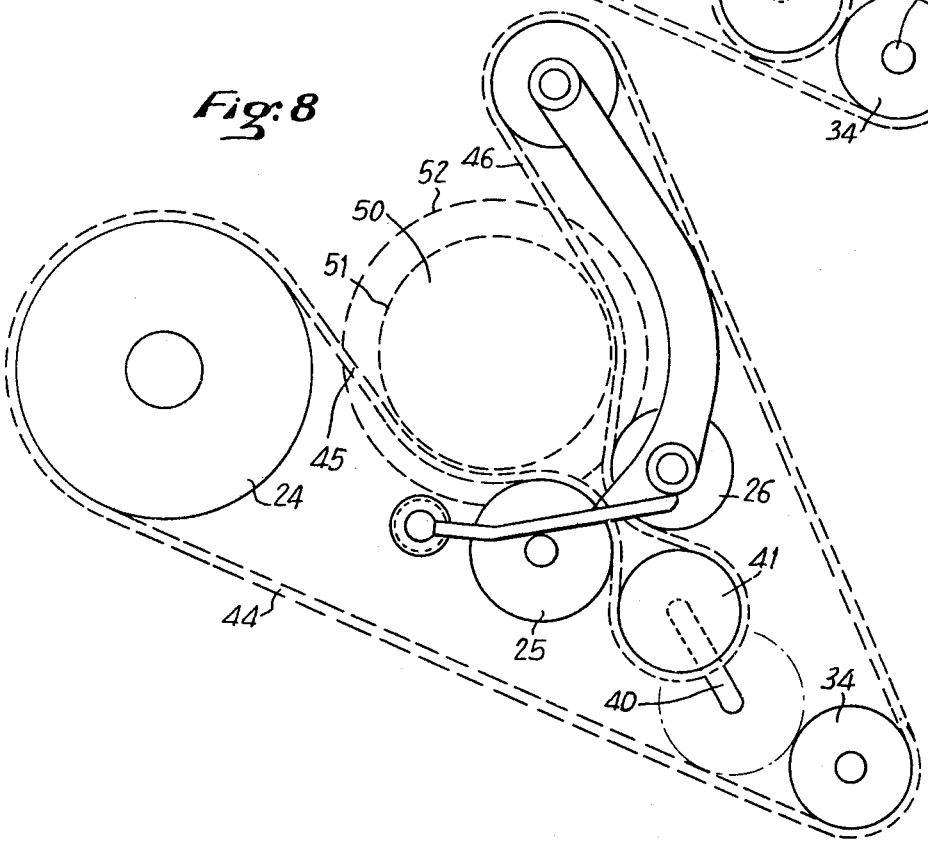
Figure 9:
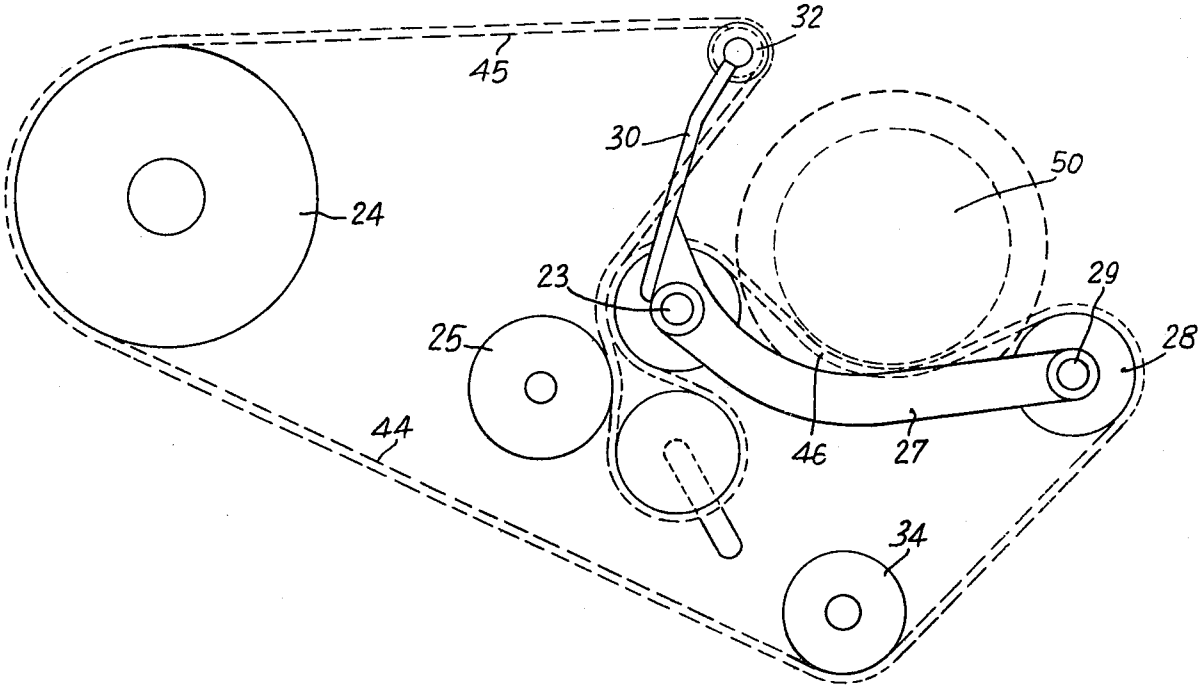

On the attached schematic drawings:

FIG. 1 is a plan view of a portion of a sheet of a wire net of simple twist, FIG. 2 is a side view of a number of rows of mesh after they have been folded back on themselves, FIG. 3 is a partial view of a roll produced by means of the apparatus according to the invention, FIG. 4 is a side view of the apparatus according to the invention, FIG. 5 is a front view of the apparatus, FIG. 6 is a top view of the apparatus, FIG. 7 is a schematic view, showing in principal, a mechanism of the apparatus according to the invention in a first configuration, FIG. 8 is a view similar to that of FIG. 4, showing the same mechanism in a second configuration, and FIG. 9 is a view similar to FIGS. 4 and 5 showing the same mechanism in a third configuration.

The portion of the sheet of net of a simple twist shown at FIG. 1 is formed of a plurality of strands of metal wire 101, 102, 103 and 104. Each wire forms a broken line so that it interlaces on one side with the wire which precedes it and on the other side with the wire which follows it.

FIG. 2 shows a sheet of netting such as sheet 100 after the rows of mesh have been folded or turned on themselves around their median line of articulation. Thus, the row formed by wires 101 and 102 is folded around line 105, the row of mesh formed by wires 102 and 103 is folded around line 106 in the opposite direction, and the row of mesh formed by wires 103 and 104 is folded around line 107 in the same direction as the row formed by wires 101 and 102.

If one rolls up the structure of FIG. 2, a roll 50 is produced, a part of which is shown at FIG. 3. The external generatrices of this roll form as shown on this Figure are a succession of chevrons with the interior edges 51 and exterior edges 52.

The apparatus according to the invention shown on FIGS. 4 to 6 includes a frame or base 1 downstream of a machine for manufacture of simple twist net, of which only the discharge roller 2 is shown on the drawings.

The discharge roller 2 rotates, when this machine is operating, at a speed which is a function of the predetermined speed at which the net is produced, and advances to the discharge of this machine. The net is thus supplied at their speed, by the discharge roller 2, in the form of an elongated flat sheet. This sheet is guided laterally by means of two flanges 3 mounted on the discharge roller 2.

The frame 1 bears, immediately downstream of discharge roller 2, a bar 4, and downstream of bar 4, a second bar 5.

On these bars 4 and 5 are supported T-angles or beams 6 whose flange is mounted on conventional supports 8, whose flange or blade 9 faces upwardly.

The angles 6 are spaced apart along the length of the bars 4 and 5 between the flanges 3 at more or less regular intervals. The distances which separate the different angles 6, one from the other, are approximately equal to a multiple of a diagonal of the mesh of the net which is to be rolled up.

In addition, curved rods 14 are fixed to the front ends of the angles 6 and are partially rolled up around drum 2.

The apparatus includes in addition, a driven shaft 10 which bears a chain wheel or sprocket 11 able to cooperate by means of chain 12 with another chain pulley 13 (FIG. 4) mounted on the shaft of the discharge roller 2. Thus when roller 2 is driven by the drive means of the net making machinery, this drive motion is transmitted to shaft 10 with a given ratio of reduction.

Another shaft 16 is mounted on the frame 1 and bears chain wheel 17. This wheel 17 is provided to cooperate with chain wheel 18 (FIG. 5) mounted on shaft 10 at its end opposite wheel 11.

Wheel 18 thus drives wheel 17 and as a result shaft 16 has a speed which is a function of the drive ratio between wheels 17 and 18. A tightening gear 20 whose axis is able to slide in guides 21 mounted on frame 1 maintains the tension of the chain 19 for different ratios of wheels 17 and 18. It is thus possible to adjust the ratio of the speeds of rotation of shaft 16 and discharge roller 2 of the net making machine.

In addition to wheel 17 which is placed outside frame 1, shaft 16 bears a plurality of sprockets 24 which are placed on this shaft so that each is located at the end of one of the angles 6.

Mounted on shafts 22 and 23 are slide plates 39 which support bearings on which are mounted chain wheels 25, concentric with shaft 22 and chain wheels 26 concentric with shaft 23. Plates 39 are adjusted transversally so that wheels 25 and 26 are positioned in pairs in the same planes as wheel 24, that is to say in the vertical plane of angle 6.

In addition articulated arms 27 at the ends of which are mounted chain wheels 28 are mounted to rotate around bearings 31 concentric with shaft 23 and chain wheel 26, the bearings 31 being borne by the plates 39.

The arms 27 are fixed to one after the other for rotation by a shaft 29 passing through the axes of pulleys 28.

In addition, levers 30 attached to the arms 27 are likewise able to pivot around bearings 31 and bear at their ends chain wheels 32 which are located in the same plane as the wheel 28. Arms 27 and levers 30 to which they are fixed are disposed on bearings 31 so that wheels 28 and 32 are located in the same plane as wheels 24, 25 and 26.

In addition, shaft 33 is supported by frame 1, and supports chain wheels 34, each disposed in the planes defined by the wheels 24, 25, 26, 28 and 32.

Finally, a last shaft 35 is mounted on the frame 1.

Shaft 35 supports two flanges 36 mounted on the slide bearings 37 and able to be adjusted to be located in the same plane as flanges 3 of the discharge roller 2. Flanges 36 can be fixed in position by fixing means 38 provided on bearings 37.

In addition, each plate 39, comprises a slot or groove 40 (FIG. 4), in which the axle of the chain wheel 41 can slide. The axle of wheel 41 is pulled back toward the bottom, that is to say in a direction opposite pulleys 24 and 28 with respect to pulleys 25 and 26, by a spring 42 whose one end is mounted on the spindle of pulley 41 and whose other end is fixed to an extension 43 of plate 39.

Finally chains 44 pass over each of the assemblies of wheels 24, 25, 26, 28, 33 and 41. Between wheels 24 and 25 of one section and pulleys 26 and 28 of the other section, strands or rims 45 and 46 respectively of the chain form a V as can be seen on FIG. 4.

In the embodiment shown on this Figure, the strand 45 is essentially in the extension of the top edges of angle 6, and makes with the horizontal an angle of approximately 40°, and the strand 46 makes with strand 45 an angle of essentially 40°.

One notes in addition that shaft 5 is mounted to move in rotation with respect to frame 1 and can be actuated with the assistance of counterweights 47. Fingers 48 are fixed to the axle 5 so that they pivot with the latter when counterweight 47 is swung.

The operation of the apparatus described above is as follows.

Being given the diameter of discharge roller 2, the reduction ratio between wheels 11 and 13, the reduction ratio between wheels 18 and 17 and the diameter of wheels 24, it is possible to determine the ratio between the speed of supply of the net at the roller 2 and the longitudinal or linear speed of chain 44.

Preferably, for a net with a mesh gauge of 50 millimeters, this ratio can be equal to 0.25.

The counterweight 47 being in a position such that the fingers 48 are withdrawn with respect to angles 6, the net is fed on these angles to strand 45 of chain 44. Before the rolling up begins, the apparatus is in the position shown at FIG. 7 with strands 45 and 46 taut and the axes of wheel 41 at the bottom of guides 40 where they are maintained by the pull of springs 42.

The normal position for arms 27 and levers 30 is that shown at FIG. 7, in which the strands 45 and 46 form a V and in which sprocket 32 is separated from strand 45.

It is to be understood that because of the slower advance of chain 44 relative to the speed of feed of the net, this latter has a tendency to fall back on itself so that each row of mesh is folded under on itself around its median line of articulation and rolls up as is shown in FIG. 8 in the form of a roll 50 whose generatrices form chevrons with interior edges 51 and exterior edges 52. Strands 45 and 46 of chain 44 consequently support roll 50 by engaging the interiors of the chevrons thus formed.

As the diameter of roll 50 increases strands 45 and 46 of chain 44 curve inwardly as shown on FIG. 5 so that the axes of wheels 41 approach wheels 25 and 26 at the inside guides 40.

When roll 50 is finished, the sheet of net is cut between discharge roller 2 and axle 5, and fingers 48 are rotated to the position shown on FIG. 4. Consequently the part of the sheet located below the cut completes roll 50 while the part above it is blocked by fingers 48, so that the net may continue to be fed by discharge roller 2 during the operation described below during which roll 50 is removed from the device.

The assembly of arms 27 is swung rearwardly to the position shown on FIG. 9, driving with it shaft 29 and chain wheels 28. In this movement, levers 30 are also rotated and they drive wheels 32.

Thus strand 46 of chain 44 becomes basically horizontal while wheel 32 deforms strand 45 which thus rotates roll 50 on horizontal strands 46 from which it can be removed.

Arms 47 are then returned to the position which they occupy in FIGS. 4 and 7. Fingers 48 are again retracted so that a new sheet of net comes into position between strands 45 and 46 where it begins to roll up as was described with reference to FIG. 7.

The invention thus provides apparatus allowing a simple twist net to be made into a compact roll, without its being necessary to stop the manufacturing installation for this net, during the manipulation of the finished rolls. It will also be possible to obtain a very great regularity of winding.

I claim:

1. Apparatus for rolling up wire mesh of simple twist of the type in which each row of mesh is of zig-zag configuration with alternate generally V-shaped equally spaced peaks and valleys, the peaks of one row are looped through the valleys of an adjacent row to connect the rows together, and adjacent rows of mesh can be folded back alternately toward each other, around lines of articulation formed by the looped-together peaks and valleys of adjacent rows and rolled up to form a compact roll of folded back rows having alternate V-shaped crests and depressions, said apparatus comprising, first and second means for receiving said mesh to form said roll, said means being adapted to receive mesh fed at a predetermined speed from the discharge of a mesh forming machine, each receiving means comprising a first length of a strand and a second length of a strand in opposed relation to said first length of strand, means mounting said first receiving means with the strands thereof in a first vertical plane in the path of and parallel to the direction of feed of the mesh, means mounting said second receiving means with the strands thereof in a second vertical plane parallel to and in the path of the direction of feed of the mesh and spaced from the first plane by a distance equal to a multiple of the distance between peaks of the rows of mesh, said strands comprising means for supporting the roll by engaging the roll in said V-shaped depressions, and means for driving said strands at a linear speed less than said predetermined speed to roll up said folded back mesh into a roll.

2. Apparatus according to claim 1 wherein the ratio between the speed of said strands and said predetermined speed is on the order of 0.25.

3. Apparatus according to claim 1 wherein said first strand of each receiving means comprises, a strand at an angle of about 40° with horizontal, and said mesh is fed downwardly onto said first strands.

4. Apparatus according to claim 1 wherein the first and second strands extend at an angle on the order of 40° with respect to each other.

5. Device according to claim 1 wherein said first and second strands comprise strands of an endless chain extending around a plurality of wheels.

* * * * *